US011557270B2

(12) United States Patent
Maezawa

(10) Patent No.: US 11,557,270 B2
(45) Date of Patent: Jan. 17, 2023

(54) PERFORMANCE ANALYSIS METHOD AND PERFORMANCE ANALYSIS DEVICE

(71) Applicant: Yamaha Corporation, Shizuoka (JP)

(72) Inventor: Akira Maezawa, Shizuoka (JP)

(73) Assignee: YAMAHA CORPORATION, Shizuoka (JP)

( * ) Notice: Subject to any disclaimer, the term of this patent is extended or adjusted under 35 U.S.C. 154(b) by 263 days.

(21) Appl. No.: 17/008,460

(22) Filed: Aug. 31, 2020

(65) Prior Publication Data

US 2020/0394991 A1 Dec. 17, 2020

Related U.S. Application Data

(63) Continuation of application No. PCT/JP2019/006049, filed on Feb. 19, 2019.

(30) Foreign Application Priority Data

Mar. 20, 2018 (JP) ..... JP2018-052863

(51) Int. Cl.
*G10H 1/00* (2006.01)

(52) U.S. Cl.
CPC ..... *G10H 1/0033* (2013.01); *G10H 1/0008* (2013.01); *G10H 2210/061* (2013.01); *G10H 2210/091* (2013.01)

(58) Field of Classification Search
CPC ..... G10H 1/0033; G10H 1/0008; G10H 2210/061; G10H 2210/091
USPC ..... 84/601
See application file for complete search history.

(56) References Cited

U.S. PATENT DOCUMENTS 5,616,877 A * 4/1997 Tamura ..... G10H 1/0066 84/634
6,166,314 A * 12/2000 Weinstock ..... G10H 1/366 84/484
6,376,758 B1 * 4/2002 Yamada ..... G10H 1/40 84/610
7,164,076 B2 * 1/2007 McHale ..... G10H 1/368 84/645
7,361,829 B2 * 4/2008 Uehara ..... G10G 1/02 84/746

(Continued)

FOREIGN PATENT DOCUMENTS

JP 2009014978 A 1/2009
JP 2011180590 A 9/2011

(Continued)

OTHER PUBLICATIONS

International Search Report in PCT/JP2019/006049, dated May 14, 2019.

*Primary Examiner* — Christina M Schreiber
(74) *Attorney, Agent, or Firm* — Global IP Counselors, LLP

(57) ABSTRACT

A performance analysis method realized by a computer includes sequentially estimating performance positions within a musical piece by an analysis process applied to an audio signal representing a performance sound of the musical piece, and setting a performance position at a first time point on a time axis within the musical piece to a performance position corresponding to a time series of the performance positions estimated by the analysis process in a selection period prior to and spaced away from the first time point within the musical piece.

15 Claims, 3 Drawing Sheets

(56) References Cited

U.S. PATENT DOCUMENTS

| | | | | |
|---|---|---|---|---|
| 8,440,901 | B2 * | 5/2013 | Nakadai | G09B 15/02 84/612 |
| 10,366,684 | B2 * | 7/2019 | Maezawa | G10H 1/36 |
| 2005/0115382 | A1 * | 6/2005 | Jung | G09B 15/00 84/616 |
| 2010/0257995 | A1 * | 10/2010 | Kamiya | G10H 1/0025 84/645 |
| 2011/0214554 | A1 * | 9/2011 | Nakadai | G09B 15/02 84/477 R |
| 2016/0098977 | A1 * | 4/2016 | Maezawa | G10G 1/00 84/602 |
| 2017/0256246 | A1 * | 9/2017 | Maezawa | G10H 1/0033 |
| 2017/0278501 | A1 * | 9/2017 | Tabata | G10H 1/361 |
| 2017/0337910 | A1 * | 11/2017 | Maezawa | G10H 1/361 |
| 2019/0156801 | A1 * | 5/2019 | Maezawa | G10H 1/00 |
| 2019/0156802 | A1 * | 5/2019 | Maezawa | G10H 1/00 |
| 2019/0156806 | A1 * | 5/2019 | Maezawa | G10H 1/00 |
| 2019/0156809 | A1 * | 5/2019 | Maezawa | G10H 1/361 |
| 2019/0172433 | A1 * | 6/2019 | Maezawa | G10H 1/0008 |
| 2019/0213903 | A1 * | 7/2019 | Ikegami | G09B 15/002 |
| 2019/0237055 | A1 * | 8/2019 | Maezawa | G10G 3/04 |
| 2020/0134297 | A1 * | 4/2020 | Maezawa | G06F 3/012 |
| 2020/0394991 | A1 * | 12/2020 | Maezawa | G10H 1/0033 |
| 2021/0005173 | A1 * | 1/2021 | Maezawa | G10H 1/0008 |
| 2021/0319775 | A1 * | 10/2021 | Maezawa | G10H 1/053 |
| 2022/0036866 | A1 * | 2/2022 | Isozaki | G10G 1/00 |

FOREIGN PATENT DOCUMENTS

| | | | |
|---|---|---|---|
| JP | 2016099512 | A | 5/2016 |
| WO | 2018016639 | A1 | 1/2018 |

* cited by examiner

PERFORMANCE ANALYSIS METHOD AND PERFORMANCE ANALYSIS DEVICE

CROSS-REFERENCE TO RELATED APPLICATIONS

This application is a continuation application of International Application No. PCT/JP2019/006049, filed on Feb. 19, 2019, which claims priority to Japanese Patent Application No. 2018-052863 filed in Japan on Mar. 20, 2018. The entire disclosures of International Application No. PCT/JP2019/006049 and Japanese Patent Application No. 2018-052863 are hereby incorporated herein by reference.

BACKGROUND

Technological Field

The present invention relates to technology for analyzing a performance of a musical piece.

Background Information

A technology for analyzing the position in a musical piece that is being played by a performer has been proposed in the prior art. For example, Japanese Laid Open Patent Application No. 2016-099512 and International Publication No. 2018/016639 disclose technologies for estimating the performance position from a performance sound of a musical piece that a performer has actually played and controlling the reproduction of the performance sound of an accompaniment part so as to be synchronized with the progress of the performance position.

SUMMARY

An error could occur in a performance position estimated using the technology described above. If an error occurs in the performance position, it may be assumed that the performance position is corrected in accordance with an instruction from a user, for example. However, in a configuration in which the performance position estimated at the time the error occurs is used as a point of origin to correct the subsequent performance positions, there may be cases in which it is difficult to swiftly and easily correct the performance position to an appropriate position. Given the circumstances described above, an object of a preferred aspect of this disclosure is to swiftly and easily correct the performance position to the appropriate position.

In order to solve the problem described above, a performance analysis method according to a preferred aspect of this disclosure comprises sequentially estimating performance positions within a musical piece by an analysis process applied to an audio signal representing a performance sound of the musical piece, and setting a performance position at a first time point on a time axis within the musical piece to a performance position corresponding to a time series of the performance positions estimated by the analysis process in a selection period prior to and spaced away from the first time point within the musical piece.

A performance analysis device according to a preferred aspect of this disclosure comprises an electronic controller including at least one processor, and the electronic controller is configured to execute a plurality of modules including an estimation module that sequentially estimates performance positions within a musical piece by an analysis process applied to an audio signal representing a performance sound of the musical piece, and a control module that sets a performance position at a first time point on a time axis within the musical piece to a performance position corresponding to a time series of performance positions estimated by the analysis process in a selection period prior to and spaced away from the first time point within the musical piece.

According to a preferred aspect of this disclosure, a non-transitory computer readable medium stores a performance analysis program for causing a computer to execute a process that comprises sequential estimating performance positions within a musical piece by an analysis process applied to an audio signal representing a performance sound of the musical piece, and setting a performance position at a first time point on a time axis within the musical piece to a performance position corresponding to a time series of the performance positions estimated by the analysis process in a selection period prior to and spaced away before the first time point within the musical piece.

DETAILED DESCRIPTION OF THE EMBODIMENTS

Selected embodiments will now be explained with reference to the drawings. It will be apparent to those skilled in the field from this disclosure that the following descriptions of the embodiments are provided for illustration only and not for the purpose of limiting the invention as defined by the appended claims and their equivalents.

First Embodiment

Figure 1:
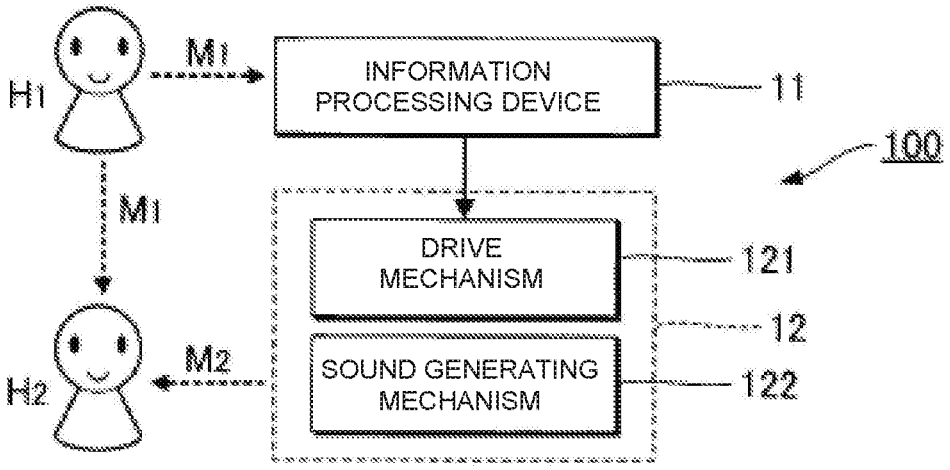
FIG. 1 is a block diagram illustrating a configuration of a performance system according to a first embodiment.

FIG. 1 is a block diagram illustrating a configuration of a performance system 100 according to a first embodiment. The performance system 100 is a computer system installed in an acoustic space, such as a music hall, in which a performer H1 is located. The performer H1 is, for example, a performer that performs a musical piece using a musical instrument, or a singer that sings a musical piece. The "performance" in the following description includes not only the playing of musical instruments, but also singing. The performance system 100 executes an automatic performance of a musical piece in parallel with the performance of the musical piece by the performer H1. As illustrated in FIG. 1, the performance system 100 according to the first embodiment comprises an information processing device 11 and a performance device 12.

The performance device 12 executes an automatic performance of a musical piece under the control of the information processing device 11. Specifically, the performance device 12 is an automatic performance instrument (for example, an automatic piano) comprising a drive mechanism 121 and a sound generation mechanism 122. In the same manner as a keyboard instrument of a natural musical instrument, for example, the sound generation mechanism 122 has a keyboard and, associated with each key, a string striking mechanism that causes a string (sound-generating body) to generate sounds in conjunction with the displacement of each key of a keyboard. The drive mechanism 121 executes the automatic performance of the target musical piece by driving the sound generation mechanism 122. The automatic performance is realized by the drive mechanism 121 driving the sound generation mechanism 122 in accordance with instructions from the information processing device 11. The information processing device 11 can also be mounted on the performance device 12.

Figure 2:
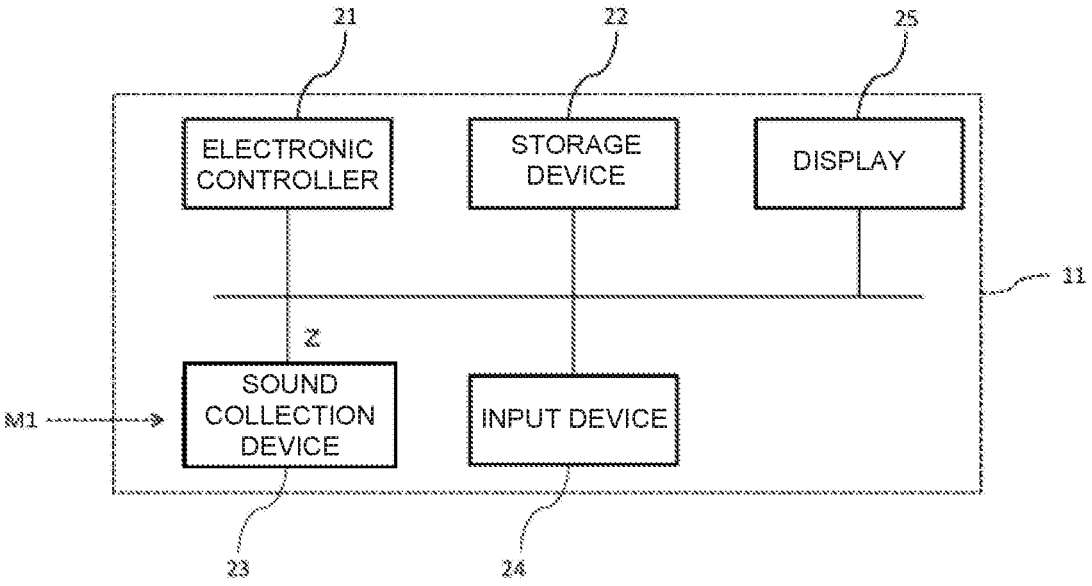
FIG. 2 is a block diagram illustrating a configuration of an information processing device.

FIG. 2 is a block diagram illustrating a configuration of the information processing device 11. The information processing device 11 is a portable information terminal such as a smartphone or a tablet terminal, or a portable or stationary information terminal such as a personal computer. As shown in FIG. 2, the information processing device 11 comprises a electronic controller 21, a storage device 22, a sound collection device 23, an input device 24, and a display 25.

The sound collection device 23 is a microphone that collects performance sounds M1 (for example, instrument sounds or singing sounds) generated by the performance of the performer H1. The sound collection device 23 generates an audio signal Z representing a waveform of the performance sound M1. An illustration of an AD converter that converts the audio signal Z from analog to digital is omitted for the sake of convenience. A configuration in which the information processing device 11 is provided with the sound collection device 23 is illustrated in FIG. 2; however, the sound collection device 23 that is separate from the information processing device 11 can be connected to the information processing device 11 wirelessly or by wire. In addition, the audio signal Z that is output from an electric musical instrument, such as an electric string instrument, can be supplied to the information processing device 11. That is, the sound collection device 23 may be omitted.

The input device 24 receives instructions from a user H2 that uses the information processing device 11. For example, a plurality of operators operated by the user H2, or a touch panel that detects touch by the user H2, is suitably used as the input device 24. The operators here can be realized as, for example, buttons, keys, knobs, levers, and the like. The touch panel is typically disposed so as to overlap the display 25. The user H2 is, for example, a manager of the performance system 100, or an organizer of a concert in which the performer H1 appears. As shown in FIG. 1, the user H2 listens to the performance sounds M1 generated by the performance of the performer H1 and performance sounds M2 generated by the automatic performance of the performance device 12.

The term "electronic controller" as used herein refers to hardware that executes software programs. The electronic controller 21 of FIG. 2 is a processing circuit such as a CPU (Central Processing Unit) having at least one processor and comprehensively controls each element of the information processing device 11. A program that is executed by the electronic controller 21 and various data that are used by the electronic controller 21 are stored in the storage device 22. A known storage medium, such as a magnetic storage medium or a semiconductor storage medium, or a combination of a plurality of various types of storage media constitute the storage device 22. In other words, the storage device 22 is any computer storage device or any computer readable medium with the sole exception of a transitory, propagating signal. For example, the storage device 22 can be a computer memory device which can be nonvolatile memory and volatile memory. The storage device 22 that is separate from the information processing device 11 can be provided, and the electronic controller 21 can read from or write to the storage device 22 via a communication network. That is, the storage device 22 may be omitted from the information processing device 11.

The display 25 is a device for displaying various types of information to the user H2, and is realized as, for example, a liquid crystal display. The display 25 can be configured integrally with the information processing device 11, or be configured as a separate body.

The storage device 22 of the first embodiment stores music data. The music data specify a time series of musical notes that constitute the musical piece. Specifically, the music data specify the pitch, volume, and sound generation period for each of a plurality of musical notes that constitute the musical piece. For example, a file in a format conforming to the MIDI (Musical Instrument Digital Interface) standard (SMF: Standard MIDI File) is suitable as the music data.

Figure 3:
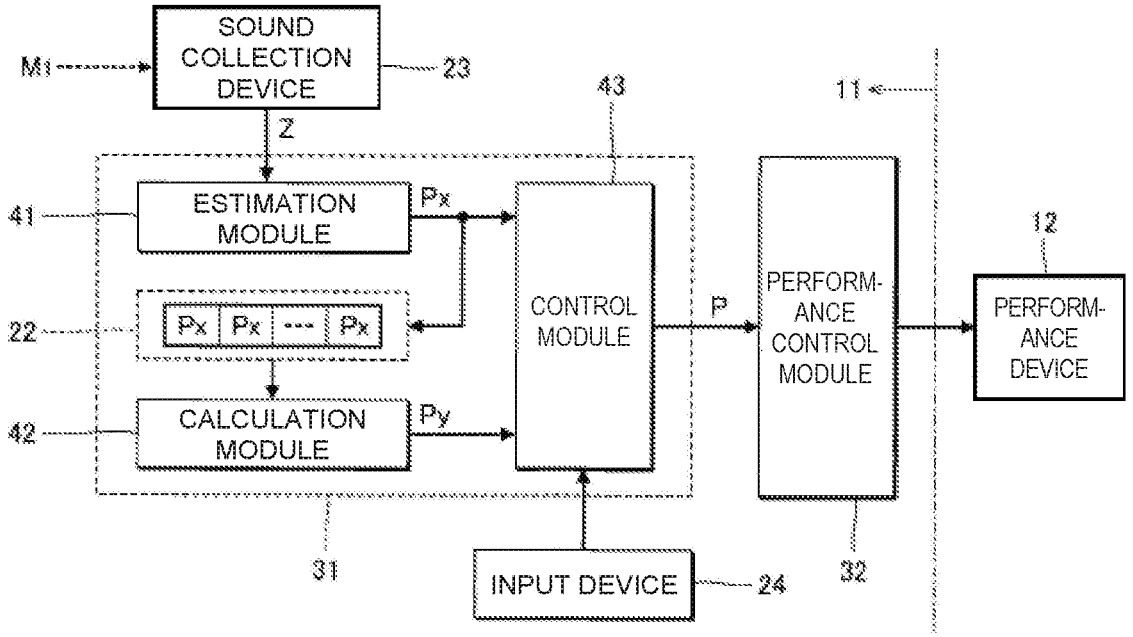
FIG. 3 is a block diagram illustrating a functional configuration of the information processing device.

FIG. 3 is a block diagram illustrating a functional configuration of the information processing device 11. As illustrated in FIG. 3, by executing a program stored in the storage device 22, the electronic controller 21 realizes a plurality of functions (performance analysis module 31 and performance control module 32) for controlling the automatic performance of the performance device 12 in accordance with the performance by the performer H1. Moreover, the functions of the electronic controller 21 can be realized by a collection of a plurality of processing circuits, or, some or all of the functions of the electronic controller 21 can be realized by a dedicated electronic circuit. In addition, a computer, such as a server device, which is located away from the acoustic space in which the performance device 12 is installed, can realize some or all of the functions of the electronic controller 21.

The performance analysis module 31 analyzes the audio signal Z supplied by the sound collection device 23 to thereby specify the performance position P within the musical piece. The performance position P is the point in time in the musical piece where the performer H1 is currently playing. It can be said that the performance position P is the position on a musical score indicated by the music data where the performer H1 is currently playing. The performance position P is repeatedly specified in parallel with the performance of the musical piece by the performer H1. The performance position P specified by the performance analysis module 31 moves toward the end of the musical piece over time. As can be understood from the foregoing description, the information processing device 11 according to the first embodiment functions as a performance analysis device that analyzes the audio signal Z to thereby specify the performance position P.

The performance control module 32 controls the automatic performance by the performance device 12 in parallel with the performance of the musical piece by the performer H1. The performance control module 32 controls the automatic performance in accordance with the performance position P specified by the performance analysis module 31. Specifically, the performance control module 32 controls the progress of the automatic performance in accordance with the performance position P such that the automatic performance of the performance device 12 follows the performance by the performer H1. That is, the performance control module 32 provides an instruction to the performance device 12 to play the performance specified by the music data with respect to the performance position P (at the performance position P). For example, an instruction to generate or mute a sound of a note specified by the music data (for example, MIDI even data) is output from the performance control module 32 to the performance device 12.

As illustrated in FIG. 3, the performance analysis module 31 according to the first embodiment comprises an estimation module 41, a calculation module 42, and a control module 43. The estimation module 41 sequentially estimates performance positions Px by a prescribed process (hereinafter referred to as "analysis process") for analyzing the audio signal Z generated by the sound collection device 23. That is, the performance positions Px are estimated by an analysis process with respect to time points (at time points) that are different from each other on a time axis. A known audio analysis technique (score alignment) disclosed, for example, in Japanese Laid Open Patent Application No. 2016-099512 or International Publication No. 2018/016639, can be arbitrarily adopted for the estimation (that is, the analysis process) of the performance position Px. As shown in FIG. 3, the time series of the performance positions Px sequentially estimated by the estimation module 41 is stored in the storage device 22. That is, the history of the estimation result by the estimation module 41 is stored in the storage device 22.

The control module 43 specifies the performance position P. Instructions regarding the performance position P specified by the control module 43 are provided to the performance control module 32. The control module 43 according to the first embodiment basically specifies the performance position Px estimated by the estimation module 41 as the performance position P. However, there is the possibility that an error may occur in the performance position Px estimated by the estimation module 41 by the analysis process. The control module 43 sets a performance position at a first time point t1 on a time axis within the musical piece to a performance position Py corresponding to a time series of performance positions Px estimated by the analysis process in a selection period Q prior to and spaced away from the first time point t1 within the musical piece. More specifically, when an error occurs in the performance position Px, the control module 43 according to the first embodiment changes the performance position Px estimated by the analysis process to a performance position Py at which the error is reduced. That is, the performance position P for which instructions were provided by the performance control module 32 is corrected from the performance position Px to the performance position Py. The calculation module 42 in FIG. 3 specifies the performance position Py, which is used for correcting the performance position P. Changing and correcting the performance position here means to set the performance position P for which instruction has been provided by the performance control module 32 as the current performance position within the musical piece to the performance position Py specified by the calculation module 42 rather than the performance position Px estimated by the estimation module 41.

Figure 4:
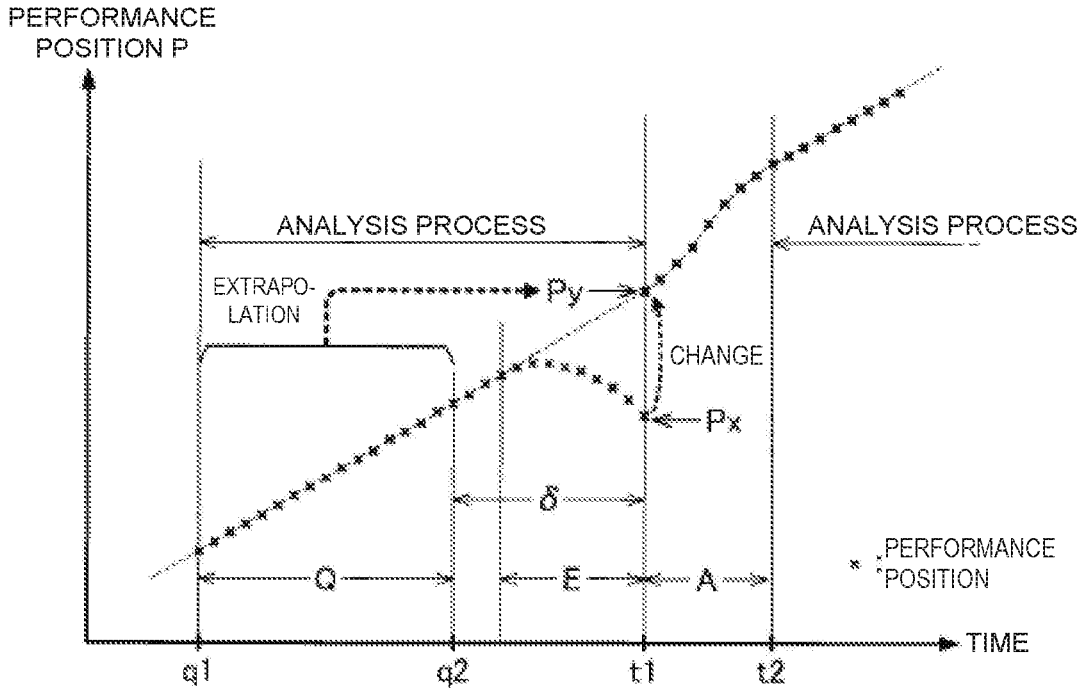
FIG. 4 is a graph illustrating temporal changes in a performance position.

FIG. 4 is a graph illustrating temporal changes in the performance position P. Error period E in FIG. 4 is a period in which the error in the performance position Px increases over time. When an error occurs in the performance position Px, the user H2 perceives a temporal shift between the performance sounds M1 of the musical instrument played by the performer H and the performance sounds M2 of the automatic performance by the performance device 12, and can thereby determine that an error has occurred in the performance position Px. When it is determined that an error has occurred in the performance position Px, the user H2 gives a prescribed instruction (hereinafer referred to as "first instruction") by operating the input device 24. Time t1 (example of a first time point) in FIG. 4 is a time point corresponding to the first instruction given to the input device 24. For example, the point in time at which the user H2 gives the first instruction is set as the time t1. As can be understood from the foregoing explanation, time t1 is the point in time at which an error has occurred in the performance position Px estimated by the analysis process. Triggered by the first instruction from the user H2, the control module 43 changes, at time t1, the performance position P from the performance position Px to the performance position Py.

The calculation module 42 specifies (specifically, extrapolates) the performance position Py from the time series of the performance position Px estimated by the estimation module 41 in a past analysis process regarding a selection period Q (in the selection period Q) positioned before time t1. The selection period Q is the period from a start point q1 to an end point q2. The start point q1 of the selection period Q is a time point before the end point q2. On the other hand, the end point q2 of the selection period Q is a time point prior to and spaced away from time t1 corresponding to the first instruction by a prescribed time length S. Time length S is set to a time length exceeding the assumed length of time from when an error starts to occur in the performance position Px to when the user H2 gives the first instruction. For example, the start point q1 of the selection period Q is set to 5 seconds before time t1, and the end point q2 is set to 2 seconds before time t1. Accordingly, within the selection period Q, it is highly likely that an error has not occurred in the performance position Px estimated by the analysis process. That is, the selection period Q is a period before the start point of the error period E. The calculation module 42 according to the first embodiment specifies the performance position Py at the time t1 after the selection period Q from the time series of the performance position Px within the selection period Q described above (that is, from the time series of the performance position Px at which an error has not occurred).

Any known time series analysis can be employed for the process by which the calculation module 42 specifies (that is, extrapolation) the performance position Py at time t1 from the time series of the performance position Px within the selection period Q. Specifically, a prediction technique such as linear prediction, polynomial prediction, Kalman filter, or the like is suitably used to specify the performance position Py. As described above, the control module 43 changes the performance position P for which instructions are provided to the performance control module 32 from the performance position Px to the performance position Py at time t1.

When the performance position P is corrected according to the procedure illustrated above, the temporal shift between the performance sounds M1 of the musical instrument played by the performer H1 and the performance sounds M2 of the automatic performance is reduced compared with the error period E. When it is determined that the error in the performance position P has been eliminated, the user H2 gives a prescribed instruction (hereinafter referred to as "second instruction") by operating the input device 24. Time t2 (example of a second time point) located after time t1 in FIG. 4 is a time point corresponding to the second instruction given to the input device 24. For example, the point in time at which the user H2 gives the second instruction is set as the time t2.

In a period A (hereinafter referred to as "adjustment period") between time t1 and time t2, the user H2 can adjust the performance position P by operating the input device 24. The control module 43 controls the transition of the performance position P within the adjustment period A in accordance with an instruction from the user H2 to the input device 24. For example, the control module 43 advances the performance position P at a speed corresponding to the instruction from the user H2. The user H2 can input such an instruction, for example, by operating a speed adjusting knob or lever included in the input device 24. In addition, the control module 43 stops the progress of the performance position P in accordance with an instruction from the user H2. The user H2 can input such an instruction, for example, by operating a pause button included in the input device 24. Additionally, the control module 43 sets a specific position on the musical score as the performance position P in accordance with an instruction from the user H2. The user H2 can input such an instruction, for example, by selecting the specific position on the musical score displayed on the display 25 using a touch panel. FIG. 4 illustrates a case in which the user H2 has advanced the performance position P within the adjustment period A. The performance position P in the adjustment period A is set, as the point of origin, using the changed performance position Py at the start point (time t1) of said adjustment period A. The result of the estimation by the estimation module 41 (performance position Px) is not reflected in the performance position P within the adjustment period A. As can be understood from the foregoing explanation, in the adjustment period A, the performance position P is adjusted in accordance with an instruction from the user H2, using the performance position Py specified by the calculation module 42 as the initial value.

The estimation module 41 stops the estimation of the performance position Px by the analysis process within the adjustment period A. That is, the analysis process is stopped triggered by the first instruction from the user H2. On the other hand, the estimation module 41 restarts the estimation of the performance position Px by the analysis process at time t2 at which the adjustment period A ends. Specifically, the estimation module 41 restarts the estimation of the performance position Px after time t2 using, as the point of origin (that is, the initial value), the performance position P specified regarding time t2 (at time t2). After time t2 (that is, after the adjustment period A has elapsed), the control module 43 provides instructions to the performance control module 32 on the performance position Px that the estimation module 41 sequentially estimates by the analysis process as the performance position P. The time series of the performance position Px estimated by the analysis process is stored in the storage device 22 in the same manner as before time t. The adjustment of the performance position P by the user H2 is allowed during periods other than the adjustment period A. However, the adjustment of the performance position P by the user H2 can be prohibited outside the adjustment period A.

Figure 5:
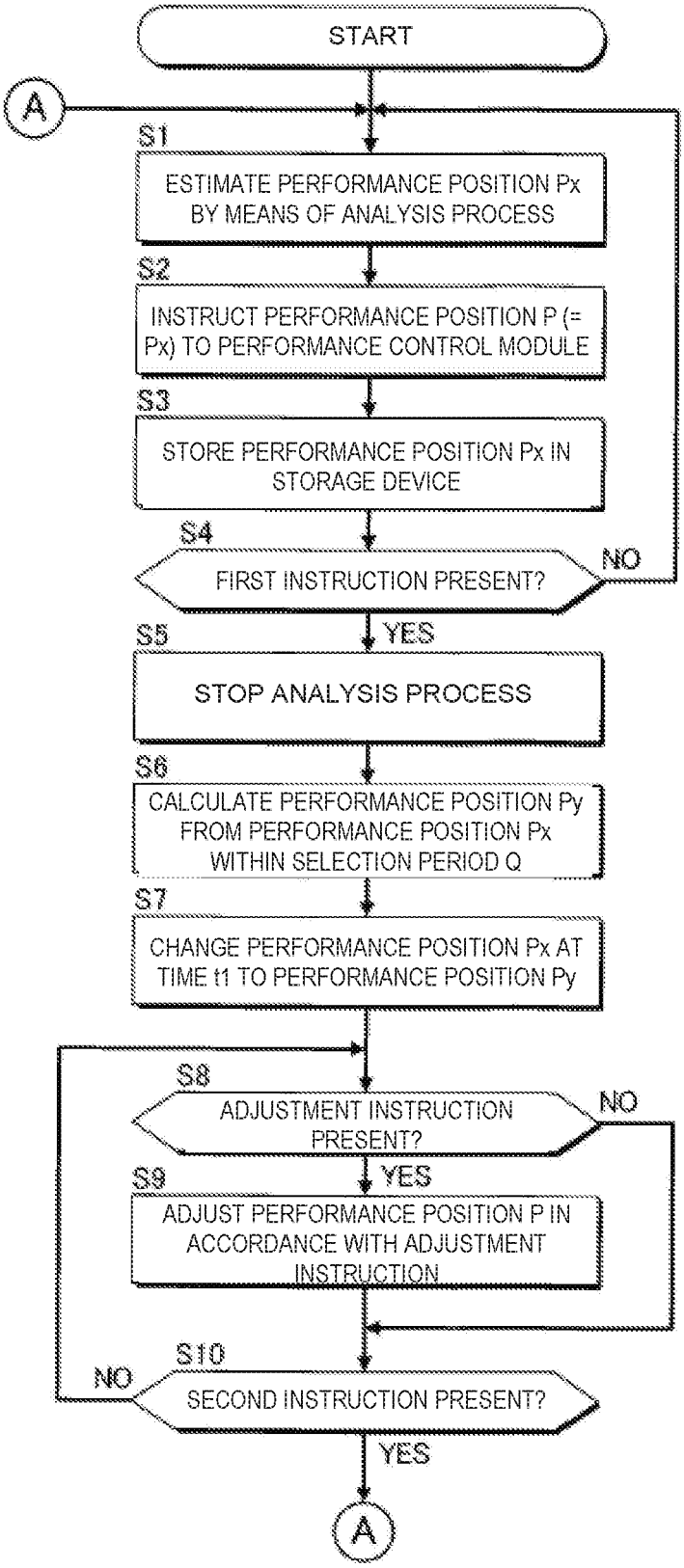
FIG. 5 is a flowchart illustrating an operation procedure of the information processing device.

FIG. 5 is a flowchart showing a specific procedure of a process executed by the electronic controller 21. For example, the process of FIG. 5 is started triggered by a prescribed operation on the input device 24. When the process of FIG. 5 is started, the estimation module 41 estimates the performance position Px by the analysis process with respect to the audio signal Z (S1). Instructions on the performance position Px estimated by the estimation module 41 are provided to the performance control module 32 as the performance position P (S2) and stored in the storage device 22 by the control module 43 (S3). The control module 43 determines whether the first instruction has been given by the user H2 (S4). The estimation of the performance position Px by the analysis process (S), the instruction (S2), and the storage (S3) are repeated until the first instruction is given (S4: NO).

When the user H2 gives the first instruction (S4: YES), the analysis process by the estimation module 41 is stopped (S5). The calculation module 42 calculates the performance position Py from the time series of the performance position Px within the selection period Q having the end point q2 before time t1 of the first instruction (S6). The control module 43 changes the performance position P for which instructions were provided to the performance control module 32 from the latest performance position Px estimated by the estimation module 41 to the performance position Py calculated by the calculation module 42 (S7).

When the instruction for the performance position Py to the performance control module 32 is started by the procedure described above, the control module 43 determines whether an instruction to adjust the performance position P has been given by the user H2 (S8). The control module 43 adjusts the performance position P in accordance with the instruction from the user H2 (S9). If the user H2 has not given the instruction to adjust (S8: NO), the performance position P is not adjusted.

The control module 43 determines whether the second instruction has been given by the user H2 (S10). The adjustment of the performance position P in accordance with the instruction from the user H2 (S8, S9) is repeated until the second instruction is given (S10: NO). When the user H2 gives the second instruction (S10: YES), the analysis process by the estimation module 41 is restarted (S1).

As described above, in the first embodiment, the performance position Px estimated by the analysis process is changed, at time t1 on a time axis, to the performance position Py corresponding to the time series of the performance position Px estimated with respect to the selection period Q (at the selection period Q) prior to and spaced away from said time t1. Accordingly, if an error occurs immediately before time t1 (for example, after the selection period Q has elapsed) in the performance position Px estimated by the analysis process, the performance position P after time t1 can be swiftly and easily corrected to the appropriate position.

For example, since an error has already occurred in the performance position Px at time t1 at which the user H2 gives the first instruction, there are cases in which it is difficult for the user H2 to adjust the subsequent performance position P to the appropriate position using the performance position Px at said time t1 as the point of origin. In the first embodiment, the performance position P estimated by the analysis process is corrected to the performance position Py corresponding to the time series of the performance position Px before the occurrence of the error. It is highly likely that the performance position Py is close to the appropriate performance position P under the assumption that no error has occurred. That is, the amount of adjustment of the performance position P required to eliminate the error in the performance position P is reduced. Accordingly, there is the advantage that the operation of the user H2 to adjust the performance position P is simplified.

In addition, in the first embodiment, since the performance position P is corrected when triggered by the first instruction to the input device 24, the user H2 can correct the performance position P to the appropriate position immediately after recognizing the error in the performance position P. That is, the user H2 can be involved in the control of the performance position P at the desired point in time. In addition, since the transition of the performance position P after time t1 is controlled in accordance with the instruction to the input device 24, it is possible to cause the performance position P to transition appropriately in accordance with the instruction from the user H2, with respect to a period (at a period) in the musical piece in which accurate estimation of the performance position Px is difficult.

In the first embodiment, since the analysis process is stopped within the adjustment period A between time t1 and time t2, compared to a configuration in which the analysis process is continued during the adjustment period A, the processing load of the estimation module 41 is reduced within the adjustment period A. Additionally, since the estimation of the performance position Px by the analysis process is restarted using the performance position P at time t2 as the point of origin, it is possible to cause the performance position P to transition appropriately even with respect to time t2 and beyond (even after time t2).

Second Embodiment

The second embodiment will now be described. In each of the examples below, elements that have the same functions as in the first embodiment have been assigned the same reference symbols as those used to describe the first embodiment, and detailed descriptions thereof have been appropriately omitted.

In the second embodiment, the content of the process (S6) by which the calculation module 42 specifies the performance position Py is different from that of the first embodiment. Specifically, the calculation module 42 according to the second embodiment calculates the performance position Py from a plurality of temporary performance positions (hereinafter referred to as "provisional positions"). Each of the plurality of provisional positions is calculated from a time series of the performance position Px within the selection period Q. However, the condition for specifying the provisional position is different for each of the plurality of provisional positions. The following items are examples of the conditions for specifying the provisional positions.

(1) Method for specifying the provisional position (linear prediction/polynomial prediction/Kalman filter).

(2) Time length and position of the selection period Q on the time axis (time of the start point q1 or the end point q2).

(3) Number of performance positions Px used for specifying the provisional position.

The calculation module 42 specifies the provisional position for each of a plurality of cases in which the conditions shown above are different. Accordingly, each of the plurality of provisional positions is a different position.

The calculation module 42 specifies the performance position Py from the plurality of provisional positions. For example, the calculation module 42 specifies, as the performance position Py, a representative value (such as average value or median value) of the plurality of provisional positions. Any method of specifying the performance position Py from the plurality of provisional positions can be used. For example, from among the plurality of provisional positions, one provisional position that is closest to a position designated by the user H2 can be specified as the performance position Py.

The same effects as those of the first embodiment are realized in the second embodiment. In addition, in the second embodiment, since the performance position Py is specified from a plurality of provisional positions specified under different conditions, there is the advantage that the performance position Py at time t1 can be easily set to the appropriate position. For example, even if it highly likely that an error may occur in the performance position Px under a specific condition, it is possible to specify an accurate performance position Py in which the error is reduced by taking into consideration a plurality of provisional positions corresponding to different conditions.

Modified Example

Specific modified embodiments that are added to each aspect exemplified above are illustrated below. Two or more embodiments arbitrarily selected from the following examples can be appropriately combined as long as they are not mutually contradictory.

(1) In the analysis process for specifying the performance position Px, it is possible to calculate a reliability index (hereinafter referred to as "reliability") of said performance position Px. For example, assuming an analysis process for specifying the performance position Px from the probability (likelihood) that each time point on a time axis corresponds to the performance position, the probability at the performance position Px is suitably used as the reliability. The probability that each time point on a time axis corresponds to the performance position is the posterior probability that said time point is the performance position Px under the condition in which the audio signal Z is observed. As the error of the performance position Px becomes smaller, the reliability of the performance position Px becomes a larger numerical value. The reliability of each performance position Px described above can be used to specify the performance position Py.

For example, the calculation module 42 can specify the performance position Py using a series of periods in which the reliability of the performance position Px exceeds a prescribed threshold value as the selection period Q. That is, the performance position Py is specified from a plurality of performance positions Px in which the reliability exceeds the threshold value. Additionally, the performance position Py can be specified from two or more performance positions Px from among a plurality of performance positions Px within a prescribed selection period Q in which the reliability exceeds the threshold value.

(2) In each of the embodiments described above, the time point of the first instruction from the user H2 is exemplified as time t1, but the method for setting time t1 is not limited to the example described above. For example, a point in time at which the reliability of the performance position Px decreases to a numerical value below a prescribed threshold value can be set as time t1. That is, the performance position Px is changed to the performance position Py triggered by the reliability of the performance position Px falling below the threshold value. As can be understood from the foregoing explanation, reception of the first instruction from the user H2 may be omitted.

(3) In each of the embodiments described above, the analysis process is stopped within the adjustment period A, but the operation to stop the analysis process may be omitted. For example, the estimation module 41 can estimate the performance position Px by an analysis process from immediately after time t1 using, as the point of origin, the changed performance position P at time t1. That is, the adjustment of the performance position P by the user H2 (adjustment period A) may be omitted.

(4) In each of the embodiments described above, the estimation module 41 estimates the performance position Px by an analysis process, but the estimation module 41 can estimate a performance speed (tempo) Tx in addition to the performance position Px. Similarly, the calculation module 42 can calculate a performance speed Ty at time t1 from a time series of the performance speed Tx within the selection period Q, in addition to the process for calculating the performance position Py from the time series of the performance position Px within the selection period Q. The control module 43 changes the performance position P at the performance speed Ty immediately after time t1.

(5) The function of the information processing device 11 according to the embodiment described above is realized by cooperation between a computer (for example, the electronic controller 21) and a program. A program according to a preferred aspect of this disclosure causes a computer to execute an analysis process (S) for sequentially estimating the performance position Px within the musical piece from the audio signal Z representing the performance sounds M1 of the musical piece, and a control process (S7) for changing, at time t on a time axis, the performance position Px estimated by the analysis process to the performance position Py corresponding to the time series of the performance position Px estimated by the analysis process with respect to the selection period Q. The program according to the embodiment described above can be stored on a computer-readable storage medium and installed on a computer. The storage medium, for example, is a non-transitory storage medium, a good example of which is an optical storage medium (optical disc) such as a CD-ROM, but can include storage mediums of any known format, such as a semiconductor storage medium or a magnetic storage medium. Non-transitory storage media include any storage medium that excludes transitory propagating signals and does not exclude volatile storage media. Furthermore, the program can be delivered to a computer in the form of distribution via a communication network.

ADDITIONAL STATEMENT

For example, the following configurations can be understood from the embodiments exemplified above.

The performance analysis method according one aspect of this disclosure comprises sequentially estimating a performance position within a musical piece by means of an analysis process applied to an audio signal representing a performance sound of the musical piece, and changing, at a first time point on a time axis, the performance position estimated by means of the analysis process to a performance position corresponding to a time series of the performance position estimated by means of the analysis process with respect to a selection period prior to and spaced away from the first time point. Alternatively, the performance position within the musical piece is set, at a first time point on a time axis, to a performance position corresponding to a time series of a performance position estimated by means of the analysis process with respect to a selection period spaced away before the first time point. In the aspect described above, the performance position estimated by means of the analysis process is changed, at the first time point on a time axis, to the performance position corresponding to the time series of the performance position estimated with respect to the selection period prior to and spaced away from said first time point. Accordingly, if an error occurs immediately before the first time point (for example, after the selection period has elapsed) in the performance position estimated by means of the analysis process, the performance position after the first time point can be swiftly and easily corrected to the appropriate position.

In another aspect of this disclosure, the first time point is a time point corresponding to an instruction from the user. In the aspect described above, since the point in time corresponding to an instruction from the user is the first time point, the user can correct the performance position to the appropriate position immediately after recognizing the error in the performance position, for example.

In another aspect of this disclosure, the transition of the performance position after the first time point is controlled in accordance with an instruction from the user. In the aspect described above, since the transition of the performance position after the first time point is controlled in accordance with the instruction from the user, it is possible to cause the performance position to transition appropriately in accordance with the instruction from the user, with respect to a period in the musical piece in which accurate estimation of the performance position is difficult.

In another aspect of this disclosure, estimation of the performance position by means of the analysis process is stopped during an adjustment period between the first time point and a second time point after the first time point, and the estimation of the performance position by means of the analysis process is restarted at the second time point, using the performance position at the second time point as a point of origin. In the aspect described above, since the estimation of the performance position by means of the analysis process is stopped within the adjustment period between the first time point and the second time point, the processing load of the estimation unit is reduced within the adjustment period. Additionally, since the estimation of the performance position by means of the analysis process is restarted using the performance position at the second time point as the point of origin, it is possible to cause the performance position to transition appropriately even after the second time point.

In another aspect of this disclosure, the changed performance position or the performance position at the first time point is specified from a plurality of provisional positions specified under different conditions. In the aspect described above, since the changed performance position is specified from the plurality of provisional positions specified under different conditions, there is the advantage that the performance position at the first time point can be easily set to the appropriate position.

The preferred aspect of this disclosure can also be realized by a performance analysis device that executes the performance analysis method of each aspect exemplified above or by a program that causes a computer to execute the performance analysis method of each aspect exemplified above.

For example, in another aspect of this disclosure, a performance analysis device comprises an estimation unit that sequentially estimates a performance position within a musical piece by means of an analysis process applied to an audio signal representing a performance sound of the musical piece, and a control unit that changes, at a first time point on a time axis, the performance position estimated by means of the analysis process to a performance position corresponding to a time series of the performance position estimated by means of the analysis process with respect to a selection period prior to and spaced away from the first time point. Alternatively, the performance analysis device comprises a control unit that sets, at a first time point on a time axis, the performance position within the musical piece to a performance position corresponding to a time series of the performance position estimated by means of the analysis process with respect to a selection period prior to and spaced away from the first time point.

What is claimed is:

1. A performance analysis method realized by a computer, the performance analysis method comprising:

sequentially estimating performance positions within a musical piece by an analysis process applied to an audio signal representing a performance sound of the musical piece; and setting a first performance position at a first time point on a time axis within the musical piece to a specified performance position specified in accordance with a time series of selection-period-performance positions of the performance positions, the first performance position being one of the performance positions, which is estimated by the analysis process at the first time point, the selection-period-performance positions being performance positions estimated by the analysis process in a selection period prior to and spaced away from the first time point within the musical piece.

2. The performance analysis method according to claim 1, wherein the first time point is a time point corresponding to an instruction from a user.

3. The performance analysis method according to claim 1, further comprising controlling, in accordance with an instruction from a user, transition of an adjustment-period-performance position which is a performance position after the specified performance position and is different from the performance positions estimated by the analysis process.

4. The performance analysis method according to claim 3, further comprising stopping the estimating of the performance positions during an adjustment period between the first time point and a second time point after the first time point, and restarting the estimating of the performance positions by the analysis process at the second time point, using, as a point of origin, a second performance position that is one of the performance positions and is estimated at the second time point.

5. The performance analysis method according to claim 1, further comprising specifying the specified performance position in accordance with the time series of the selection-period performance positions from a plurality of provisional positions calculated under conditions different from each other.

6. A performance analysis device comprising:

an electronic controller including at least one processor, the electronic controller being configured to execute a plurality of modules including an estimation module that sequentially estimates performance positions within a musical piece by an analysis process applied to an audio signal representing a performance sound of the musical piece, and a control module that sets a first performance position at a first time point on a time axis within the musical piece to a specified performance position specified in accordance with a time series of selection-period-performance positions of the performance positions, the first performance position being one of the performance positions, which is estimated by the analysis process at the first time point, the selection-period-performance positions being performance positions estimated by the analysis process in a selection period prior to and spaced away from the first time point within the musical piece.

7. The performance analysis device according to claim 6, wherein the first time point is a time point corresponding to an instruction from a user.

8. The performance analysis device according to claim 6, wherein the control module further controls, in accordance with an instruction from a user, transition of an adjustment-period-performance position which is a performance position after the specified performance position and is different from the performance positions estimated by the analysis process.

9. The performance analysis device according to claim 8, wherein the estimation module stops estimation of the performance positions during an adjustment period between the first time point and a second time point after the first time point, and restarts the estimation of the performance positions by the analysis process at the second time point, using, as a point of origin, a second performance position that is one of the performance positions and is estimated at the second time point.

10. The performance analysis device according to claim 6, wherein the electronic controller is configured to further execute a calculation module that specifies the specified performance position in accordance with the time series of the selection-period performance positions from a plurality of provisional positions calculated under conditions different from each other.

11. A non-transitory computer readable medium storing a performance analysis program for causing a computer to execute a process, the process comprising:

sequential estimating performance positions within a musical piece by an analysis process applied to an audio signal representing a performance sound of the musical piece; and setting a first performance position at a first time point on a time axis within the musical piece to a specified performance position specified in accordance with a time series of selection-period-performance positions of the performance positions, the first performance position being one of the performance positions, which is estimated by the analysis process at the first time point, the selection-period-performance positions being performance positions estimated by the analysis process in a selection period prior to and spaced away before the first time point within the musical piece.

12. The non-transitory computer readable medium according to claim 11, wherein the first time point is a time point corresponding to an instruction from a user.

13. The non-transitory computer readable medium according to claim 11, wherein the process further comprises controlling, in accordance with an instruction from a user, transition of an adjustment-period-performance position which is a performance position after the specified performance position and is different from the performance positions estimated by the analysis process.

14. The non-transitory computer readable medium according to claim 13, wherein the process further comprises stopping the estimating of the performance positions during an adjustment period between the first time point and a second time point after the first time point, and restarting the estimating of the performance positions by the analysis process at the second time point, using, as a point of origin, a second performance position that is one of the performance positions and is estimated at the second time point.

15. The non-transitory computer readable medium according to claim 11, further comprising specifying the specified performance position in accordance with the time series of the selection-period performance positions from a plurality of provisional positions calculated under conditions different from each other.

* * * * *